United States Patent [19]

Scaglia

[11] Patent Number: 5,071,081

[45] Date of Patent: Dec. 10, 1991

[54] METHOD AND DEVICE FOR MARKING AND IDENTIFYING TEXTILE SUPPORTS

[76] Inventor: Enzo Scaglia, 21, Via Monte Rosa, Milano, Italy, 20149

[21] Appl. No.: 523,261

[22] Filed: May 14, 1990

Related U.S. Application Data

[63] Continuation of Ser. No. 249,324, Sep. 26, 1988, abandoned.

[30] Foreign Application Priority Data

Oct. 12, 1987 [IT] Italy ..... 22222 A/87

[51] Int. Cl.[5] ..... B65H 75/10; B07C 5/00

[52] U.S. Cl. ..... 242/1; 242/118.3; 242/130; 209/927

[58] Field of Search ..... 242/1, 118.3, 118.32, 242/118.4, 118.7, 130, 129.5; 40/309; 209/3.3, 927

[56] References Cited

U.S. PATENT DOCUMENTS

| | | | |
|---|---|---|---|
| 1,645,432 | 10/1927 | Lauffer | 40/309 |
| 1,865,908 | 7/1932 | Hengst | 40/309 |
| 2,350,136 | 5/1944 | Warren et al. | 242/1 |
| 2,678,781 | 5/1954 | Dunlap | 40/309 X |
| 3,227,134 | 1/1966 | Wagner | 242/1 |
| 3,384,314 | 7/1966 | DiMeglio | 242/27 |
| 3,563,376 | 2/1971 | Zegna | 209/3.3 |
| 3,592,407 | 7/1971 | Hagman et al. | 242/118.3 |
| 3,606,012 | 9/1971 | Brouwer | 209/927 X |
| 4,074,875 | 2/1978 | Fratturo | 242/118.3 |
| 4,489,541 | 12/1984 | Boling | 242/118.3 X |
| 4,681,231 | 7/1987 | Ueda et al. | 209/924 X |
| 4,694,949 | 9/1987 | Nakagawa | 242/355 A X |
| 4,736,579 | 4/1988 | Stenmans | 242/118.3 X |

FOREIGN PATENT DOCUMENTS

| | | | |
|---|---|---|---|
| 1181598 | 11/1964 | Fed. Rep. of Germany | 242/1 |

*Primary Examiner*—Daniel P. Stodola
*Assistant Examiner*—P. Bowen
*Attorney, Agent, or Firm*—Lerner, David, Littenberg, Krumholz & Mentlik

[57] ABSTRACT

Methods for identifying textile supports are disclosed, including providing a reference element at a fixed location relative to the longitudinal axis of the textile support, adjusting the reference element to establish a predetermined location for the textile support, and identifying the textile support by determining the location of the reference element with respect to a fixed location relative to the longitudinal axis of the textile support. Apparatus for identifying textile supports are also disclosed, including a fixed sensor at a fixed location spaced from a textile support along its longitudinal axis and a movable reference element at a fixed location relative to the longitudinal axis of the textile support and movable with respect to the fixed sensor so that the textile support can be identified by determining the location of the movable reference element with respect to the fixed sensor.

11 Claims, 2 Drawing Sheets

METHOD AND DEVICE FOR MARKING AND IDENTIFYING TEXTILE SUPPORTS

This is a continuation of application Ser. No. 07/249,324 filed Sept. 26, 1988, now abandoned.

FIELD OF THE INVENTION

The present invention relates to methods and apparatus for marking and identifying bobbins, reels or similar textile supports. More particularly, the present invention relates to such methods and apparatus for the selection of textile supports in automatic equipment for the feeding of textile machines.

BACKGROUND OF THE INVENTION

In the textile industry, as in all sectors of the manufacturing industry, most of the innovative efforts are directed to reducing the personnel necessary in the various productive cycles. For this purpose, several types of equipment have been developed to automatically feed textile machines.

For obvious economical reasons it is necessary to use a single feeder for several machines. Since these machines must, however, operate with different types of products, such a single feeder must, therefore, simultaneously handle bobbins and reels with different type yarns, which makes it necessary for these bobbins and reels to be identified so that it will be possible to select the yarn suitable for each single machine.

On the other hand, because of the need to use bobbins or reels with different structures, due to their different manufacture and/or subsequent modifications, the problem of identifying and selecting them occurs not only before sending them to the relevant machine, namely when they are still "full," but also when they are "empty," i.e., after they have been removed from said machines and before they are loaded again with the appropriate yarn or roving.

Accordingly, there still remains a need for a method and a device which allows for the easy selection and identification of bobbins and reels, which are to be fed to textile machines, thereby avoiding the necessity to re-identify and select them before rovings or yarns are again wound thereon.

It is, therefore, an object of the present invention to solve these problems by providing a method and device for marking and identifying bobbins, reels or similar textile supports, in order to carry out their selection immediately before they are fed to their relevant textile machines.

Another object of the present invention is to provide an easy, reproducible and reliable marking method and marking device of a mechanical type.

SUMMARY OF THE INVENTION

In accordance with the present invention, it has now been discovered that these and other objects can be achieved by providing a method for marking and identifying bobbins, reels, or similar textile supports in order to select them in automatic equipment which is adopted for the feeding of textile machines in which the textile support identifying information is the distance between a reference element fixed on the bobbin run and a reference element which is movable with the bobbin itself. Also in accordance with the present invention a device has been discovered for marking and identifying bobbins, reels, or similar textile supports which comprises a reference element which is movable with the bobbin and a fixed reference element consisting of a sensor element which is placed in a fixed location along the run of the bobbin or the like for the purpose of detecting the position of the movable reference element with respect thereto.

In accordance with one embodiment of the method of the present invention for identifying textile supports, the method includes providing plurality of a reference elements at a location relative to the axis of the textile support, and adjusting that position of the reference element so as to establish a plurality of different predetermined locations for the textile supports, whereby each of the textile supports can be identified by determining the plurality of different predetermined locations of each of the reference elements with respect to a fixed location relative to the axis of the textile supports.

In accordance with a preferred embodiment of the method of the present invention, the textile support is a bobbin or reel, and the reference element is integral with the textile support so that adjusting of the reference element includes adjusting the location of the textile support with respect to the longitudinal axis of that textile support. In another embodiment, however, the textile support includes support means comprising a support arm extending along the longitudinal axis of the textile support for supporting the textile support and a base member extending substantially perpendicular to the support arm so that adjusting of the reference element includes adjusting the length of the support arm.

In accordance with one embodiment of the apparatus of the present invention, the apparatus includes fixed sensor means at a fixed location spaced from a textile support along its longitudinal axis, a movable reference element at a fixed location relative to the longitudinal axis of the textile support and movable with respect to the fixed sensor means, so that the textile support can be identified by determining the location of the movable reference element with respect to the fixed sensor means.

In accordance with a preferred embodiment of the apparatus of the present invention, the textile support is a bobbin or reel, and the fixed sensor means photoelectric sensors.

BRIEF DESCRIPTION OF THE DRAWINGS

The present invention will be now described in more detail with reference to the attached drawings, which are intended to be illustrative and not limiting, and wherein.

DETAILED DESCRIPTION

Reference will now be made to the Figures, in which like numerals refer to like portions thereof.

Figure 1:
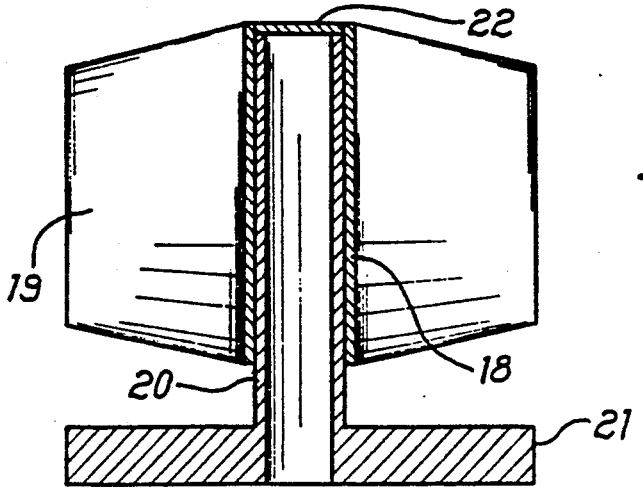
FIG. 1 is a side, elevational, partially cross-sectional view of a bobbin placed upon a second marking support in accordance with the present invention.

Referring first to FIG. 1, the bobbin shown in cross-section therein is formed by a small tube 18 on which a roving or yarn 19 is wound. The small tube 15 is inserted on a vertical hollow arm 20 of an inverted shaped support 21.

Figure 2:
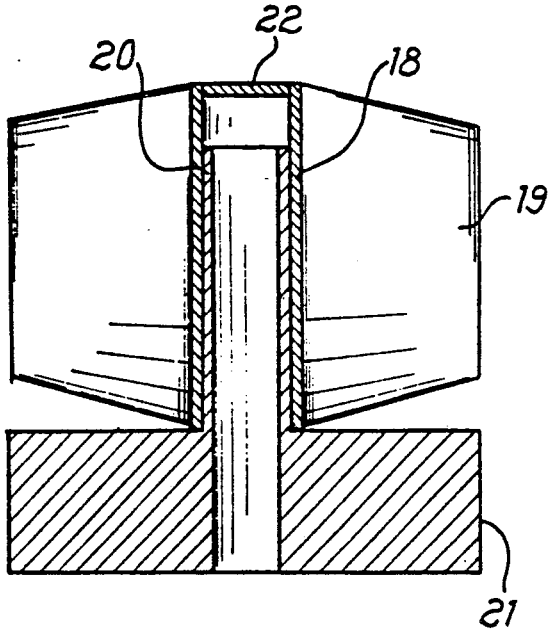
FIG. 2 is a side, elevational, partially sectional view of a bobbin placed upon another marking support in accordance with the present invention.

The upper end of small tube 18 has a closing diaphragm which serves as a reference element movable with the bobbin and integral to it. The distance of reference element 22 from a sensor acting as a second fixed reference element, and which is positioned along the path of travel of the bobbin to the textile machine, can be adjusted by selecting reference elements having vertical arms 20 which have varying heights, or, as illustrated in FIG. 2, selecting reference elements having a support base 21 which varies in height. Of course, the reference element 22 may be positioned not only on the upper end of the small tube 18, but also in an intermediate position, according to individual configurations. In any case, for each of the reference elements having a different base height 21 there will be a corresponding different location for the reference element 22 thereof.

Figure 3:
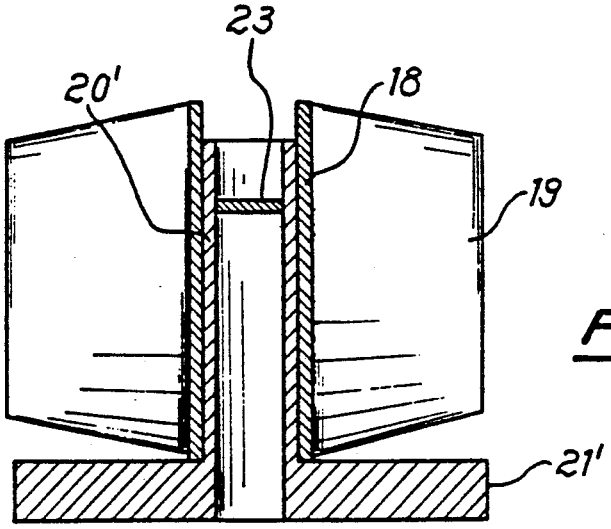
FIG. 3 is a side, elevational, partially sectional view of a bobbin including a marking support with a movable reference element in accordance with the present invention.

A reference element which may be positioned at a number of locations within the bobbin is shown in FIGS. 3 to 6. Referring first to FIG. 3, the bobbin is formed by a small tube 18 on which a roving or yarn is wound, in a manner similar to the previously illustrated embodiment. The small tube 18 is also housed on the vertical arm 20′ of a support 21′.

In this case, however, the diaphragm 22 is not present, and the movable reference element is formed by the upper surface of arm 20′, if this is closed, or by a diaphragm 23 positioned along the arm 20′ if this is hollow (which permits one to also read the distance by means of a sensor located under the bobbin and related support). As a result, in this case, a different distance, namely from the fixed reference element to the movable reference element, and therefore a different support, or an axially movable diaphragm 23, must correspond to each different type of bobbin.

Figure 4:
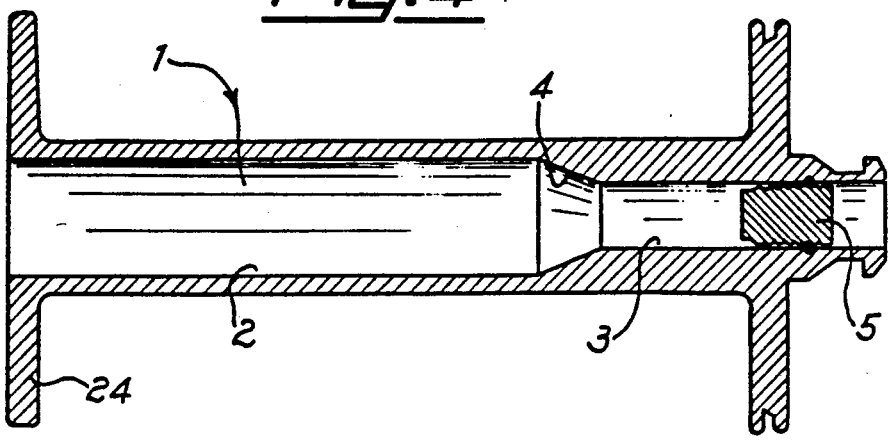
FIG. 4 is a side, elevational, sectional view of a bobbin with an internal marking device including a movable reference element according to the present invention.
Figure 5:
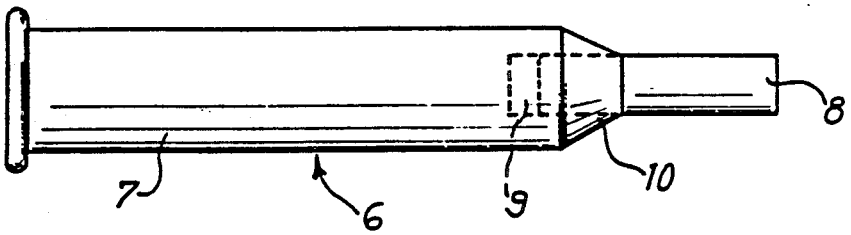
FIG. 5 is side, elevational view of a positioning gudgeon pin for use with the reference element shown in FIG. 4.
Figure 6:
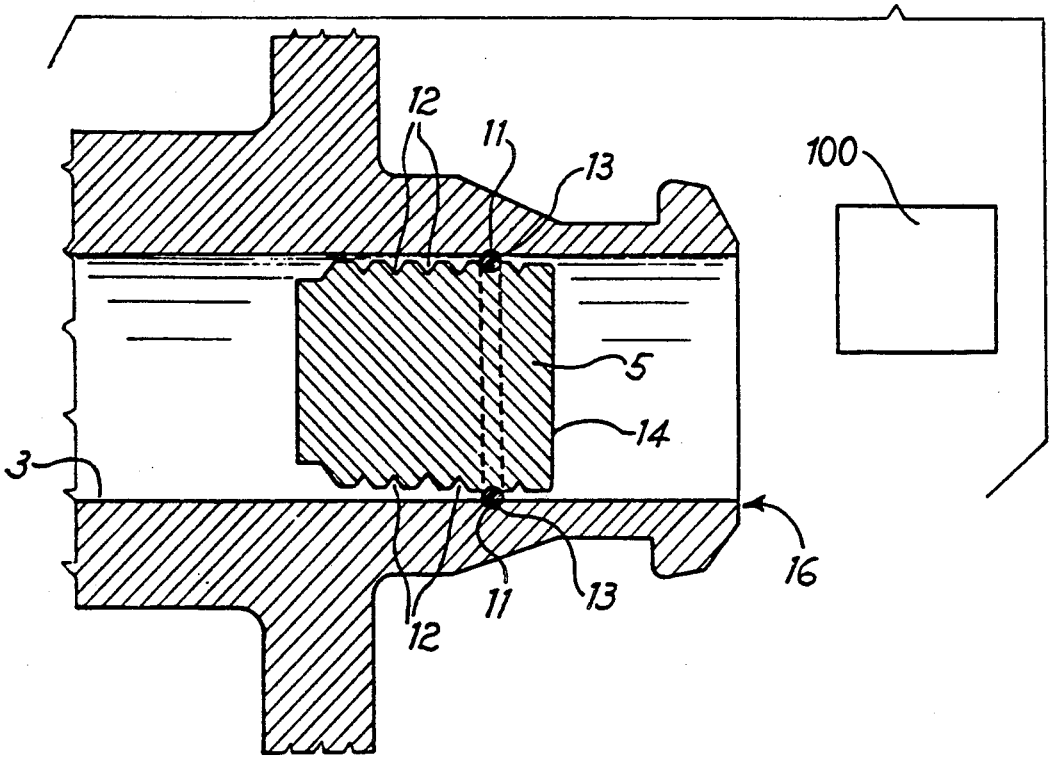
FIG. 6 is an enlarged, partial sectional view of the movable reference element and a portion of the bobbin shown in FIG. 4.

An alternative configuration is shown in FIGS. 4, 5 and 6, in which a reference element is movable with the bobbin, and movable with respect to the bobbin and pertaining to the bobbin itself.

More particularly, from FIG. 4 it can be seen that the bobbin does not need supports, in that it is provided with a supporting base 24, and that it shows in a traditional way, a hollow duct 1 coaxial with its own axis of rotation. This duct 1, which has a circular cross-section, is formed by two sections 2, 3 having different diameters, and joined by a taper 4. Along section 3, near the end zone of the bobbin, there is provided a small cylinder 5 which may also be in the form of a prism or a diaphragm, and, which is movable within a series of preset positions.

To move this small cylinder from one such position to another, a small gudgeon pin 6 (see FIG. 5) can be used, or another similar elongated body of the type shown in FIG. 5. The gudgeon pin is formed by a supporting piece 7 which is provided at one end with a taper 10 from which a spacer body 8 protrudes.

The spacer 8 is partly housed in a seat 9 provided inside the support 7, and can be further extracted from or inserted into seat 9, in order to protrude from the taper 10 for a more or less long section according to the particular needs in each case.

FIG. 6 shows a magnified section of the bobbin portion in which the movable small cylinder 5 is housed. As can be seen, the small cylinder 5 has a slightly smaller diameter than that of the portion 3 of duct 1 where it is housed. Moreover, small cylinder 5 presents a series of notches 12 provided on its side surface, and these notches 12 serve to incrementally position the small cylinder 5, cooperating with a resilient ring 13 housed in a seat 11, provided on the surface of duct 3.

The above described disposition can also be inverted, envisaging housing the elastic ring in a seat provided on the surface of the small cylinder, while a series of notches can then be provided on the corresponding surface of the hollow duct.

Each notch corresponds to a different position and, therefore, to a different distance from the external surface 14 of small cylinder 5 to the fixed reference element.

During operation with the embodiments illustrated in FIGS. 1–3, the "full" small tubes 18, namely with roving or yarn wound on them, are housed on related supports, which are selected according to the type of roving or yarn present, and which can then be transferred to their textile machine.

Each bobbin is then identified by means of a sensor which defines a fixed reference element, and which measures its own distance from the reference element movable with the bobbin being examined. The measurement of this distance is performed axially to the bobbin itself, and is carried out by means of a sensor which can be placed either in an upper or lower position with respect to the bobbin. The sensor can consist of two readers of the inductive type, one set on the desired distance and the other on an immediately smaller distance. The bobbin will thus be considered as positively identified if it gives a positive response (a positive response being one where the set value for the desired distance actually corresponds to the distance measured by the first reader) to the first reader and a negative response (a negative response being one where the set value for the described distance, which is the immediately smaller distance, does not correspond to the distance measured by the second reader) to the second reader, while two positive responses or two negative responses will thus identify a non-desired bobbin.

After their identification, bobbins are taken and used, while supports are carried elsewhere. In this manner, the bobbins constitute only small tubes, without any identifying data, and as such they can be used for any type of yarn, without the need to once again be identified and selected.

During operation with the embodiment of FIGS. 4 to 6, at the outset the bobbin generally presents a zero-set position of the small cylinder 5, namely a position in which, for example, the small cylinder 5 is at the maximum distance from the upper end of the bobbin. In order to move the small cylinder 5 to a preset position, the spacer 8 is adjusted to a preset length, corresponding to that preset position, and then the gudgeon pin 6 is inserted into the duct 1 of the bobbin from the end opposite to that housing the fixed reference element 5.

As can be seen from FIGS. 4 and 5, the support 7 and taper 10 of the gudgeon pin 6 are complementary to the section 2 and taper 4 of the hollow duct 1. The section 3 of duct 1 and the spacer 8 themselves have complementary diameters, while the length of the spacer 8 is such as to move the small cylinder 5 to one of the preselected positions between the zero position and that of maximum displacement (that is of minimum distance from the surface 14 to the fixed reference element).

The distance between the surface 14 of the small cylinder and the fixed reference element 15 is then measured by a sensor 100 in a manner similar to that described hereinabove.

Once used, the empty bobbin is "set to zero," moving the small cylinder 5 to the position of maximum distance from the reference edge 16. In this manner the bobbin can be marked again according to the type of roving or yarn which is wound onto it, thus again avoiding the need to perform another identification or selection of empty bobbins according to their marking, since, as mentioned above, such markings are all cancelled.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. A method for identifying and determining the condition of a textile support having an axis, a longitudinally extending passage, and a plurality of conditions including a first condition corresponding to the absence of textile material thereon and a plurality of second conditions corresponding to the presence of a plurality of different textile materials wound thereon, said method comprising (a) providing said textile support with a movable reference element within said passage at a first location relative to said axis of said textile support corresponding to said first condition, (b) moving said reference element within said passage to a predetermined one of a plurality of second locations corresponding to one of said plurality of second conditions corresponding to the presence of one of said plurality of different textile materials would thereon by providing a longitudinally extending control element slidable within said passage, said control element having a predetermined length corresponding to said predetermined one of said plurality of different locations within said passage, (c) returning said reference element to said first location within said passage when said one of said plurality of different textile materials has been unwound therefrom and said textile support has returned to said first condition, and repeating steps (a) through (c).

2. Apparatus for identifying and determining the condition of a textile support having an axis and a plurality of conditions including a first condition corresponding to the absence of textile material thereon and a plurality of second conditions corresponding to the presence of a plurality of different textile materials wound thereon, said apparatus comprising a textile support having at least one through passage along said axis and a movable reference element adjustably located within said through passage between a first location and a plurality of second locations therein, said first location corresponding to said first condition and said plurality of second locations corresponding to said plurality of second conditions whereby said condition of said textile support can be determined by determining the location of said movable reference element with respect to a fixed location relative to said axis of said textile support.

3. The apparatus of claim 2 wherein said textile support comprises a bobbin.

4. The apparatus of claim 2 wherein said movable reference element comprises a cylinder having a size smaller than that of said passage.

5. The apparatus of claim 2 wherein said textile support comprises a reel.

6. The apparatus of claim 2 wherein said movable reference element comprises a diaphragm having a size smaller than that of said passage.

7. The apparatus of claim 2 wherein said movable reference element has a size smaller than the size of said through passage, said apparatus including a support element mounted between said movable reference element and said passage for maintaining said movable reference element at one of said plurality of fixed locations within said passage.

8. The apparatus of claim 7 wherein said support element comprises seat means within said passage and an elastic ring located with said seat means.

9. The apparatus of claim 8 wherein said movable reference element includes a plurality of notches on its surface, each of said plurality of notches corresponding to one of said plurality of fixed locations within said passage, said notches being cooperable with said elastic ring for positioning said movable reference element within said passage.

10. The apparatus of claim 2 including a longitudinally extending control element slidable within said passage, said control element having a predetermined length corresponding to a preselected one of said plurality of first and second conditions.

11. Apparatus for identifying textile supports having an axis and including a longitudinally extending passage comprising sensor means at a fixed location spaced from said textile support along said axis along said textile support, and a movable reference element at a predetermined location relative to said axis of said textile support movable with respect to said fixed sensor means, said movable reference element being adjustably located within said passage and having a size smaller than the size of said passage, and including a plurality of notches on its surface, each of said plurality of notches corresponding to one of said plurality of fixed locations within said passage, and including a support element mounted between said movable reference element and said passage for maintaining said movable reference element at said plurality of fixed locations within said passage, said support member comprising seat means within said passage and an elastic ring located with said seat means, said notches of said movable reference element being cooperable with said elastic ring for positioning said movable reference element within said passage.

* * * * *

UNITED STATES PATENT AND TRADEMARK OFFICE

CERTIFICATE OF CORRECTION

PATENT NO. : 5,071,081

DATED : December 10, 1991

INVENTOR(S) : Enzo Scaglia

It is certified that error appears in the above-identified patent and that said Letters Patent is hereby corrected as shown below:

Column 2, line 9, following "providing" insert --a--
line 9, following "of" delete "a".
Column 2, line 44, following "means" insert --can be inductive sensors, infrared sensors, and/or--.

Signed and Sealed this

Twentieth Day of April, 1993

*Attest:*

MICHAEL K. KIRK

*Attesting Officer*

*Acting Commissioner of Patents and Trademarks*